US006651568B1

(12) United States Patent
Buono

(10) Patent No.: US 6,651,568 B1
(45) Date of Patent: Nov. 25, 2003

(54) COLLAPSIBLE TABLE

(75) Inventor: Steven A. Buono, Greeneville, TN (US)

(73) Assignee: Maxchief Investments Limited, Kaohsiung (TW)

( * ) Notice: Subject to any disclaimer, the term of this patent is extended or adjusted under 35 U.S.C. 154(b) by 0 days.

(21) Appl. No.: 10/195,265

(22) Filed: Jul. 15, 2002

(51) Int. Cl.[7] ..... A47B 3/00
(52) U.S. Cl. ..... 108/127; 108/132
(58) Field of Search ..... 108/125, 127, 108/129, 130, 131, 132; 248/188.1

(56) References Cited

U.S. PATENT DOCUMENTS

| | | | | |
|---|---|---|---|---|
| 159,227 | A | 1/1875 | Sinclair | |
| 236,197 | A | 1/1881 | Valley | |
| 1,306,466 | A * | 6/1919 | Coffin | 108/125 |
| 1,487,497 | A | 3/1924 | Whewell | |
| 1,757,260 | A | 5/1930 | Silverman | |
| 1,780,394 | A * | 11/1930 | Kalgren | 108/125 |
| 1,905,862 | A * | 4/1933 | Harman | 108/125 |
| 1,950,540 | A * | 3/1934 | Calhoun | 108/125 |
| 1,956,946 | A | 5/1934 | Duffy | |
| 2,278,810 | A | 4/1942 | Virtue et al. | |
| 2,474,450 | A | 6/1949 | Woodruff | |
| 2,939,516 | A | 6/1960 | Drew | |
| 3,072,451 | A | 1/1963 | Greenberg et al. | |
| 3,125,971 | A * | 3/1964 | Wetherill | 108/125 |
| 3,357,729 | A | 12/1967 | Krueger | |
| 3,464,373 | A * | 9/1969 | Larson | 108/125 |
| 3,777,675 | A | 12/1973 | Hanusiak | |
| 4,658,735 | A | 4/1987 | Holton | |
| 4,951,576 | A | 8/1990 | Cobos et al. | |
| D350,862 | S | 9/1994 | Beller | |
| 5,865,128 | A | 2/1999 | Tarnay | |
| D414,626 | S | 10/1999 | Collins et al. | |
| 5,984,047 | A | 11/1999 | Rogers | |
| D419,332 | S | 1/2000 | Collins et al. | |
| 6,112,674 | A | 9/2000 | Stanford | |
| 6,431,092 | B1 | 8/2002 | Stanford | |
| 6,508,184 | B1 * | 1/2003 | Winter et al. | 108/125 |

FOREIGN PATENT DOCUMENTS

JP 2000-50963 * 2/2000

OTHER PUBLICATIONS

Igloo It's For Keeps, The Most Lightweight, Durable, Versatile Table You'll Every Carry. (US).

* cited by examiner

*Primary Examiner*—Jose V. Chen
(74) *Attorney, Agent, or Firm*—Leudeka, Neely & Graham, P.C.

(57) ABSTRACT

A table assembly of the type including a table top having a lower surface with a recessed central tray region and tray sides extending between the tray region and surrounding portions of the lower surface; leg assemblies mountable adjacent the lower surface and within the central tray region, each of the leg assemblies including a bracket having a plurality of mounts and at least two extensions adjacent edges of the bracket and positioned adjacent a portion of one of the tray sides; a leg pivotally mounted to the mounts; a plurality of frame members positioned so that a portion of each of the frame members is positioned between one of the extensions of the one of the brackets, and a fastener extending through each of the extensions and a portion of the adjacent frame member and into a portion of the tray side for mounting of the frame members and the leg assemblies to the table top.

10 Claims, 7 Drawing Sheets

COLLAPSIBLE TABLE

FIELD

This invention relates to collapsible furniture. More particularly, this invention relates to tables having folding legs.

BACKGROUND AND SUMMARY

Tables having folding legs are well known in the art. However, improvement is desired in the construction of such tables to improve their compactness when the legs are folded as well as reduce their weight and improve their strength. The invention relates to an improved table assembly having folding legs.

In a preferred embodiment, the table assembly includes a table top having a lower surface with a recessed central tray region and tray sides extending between the tray region and surrounding portions of the lower surface. The table assembly also includes leg assemblies mountable adjacent the lower surface and within the central tray region. Each of the leg assemblies includes a bracket having a plurality of mounts and at least two extensions adjacent edges of the bracket and positioned adjacent a portion of one of the tray sides. A leg is pivotally mounted to the mounts and a plurality of frame members are positioned so that a portion of each of the frame members is positioned between one of the extensions of the one of the brackets. A fastener extends through each of the extensions and a portion of the adjacent frame member and into a portion of the tray side to mount the frame members and the leg assemblies to the table top.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
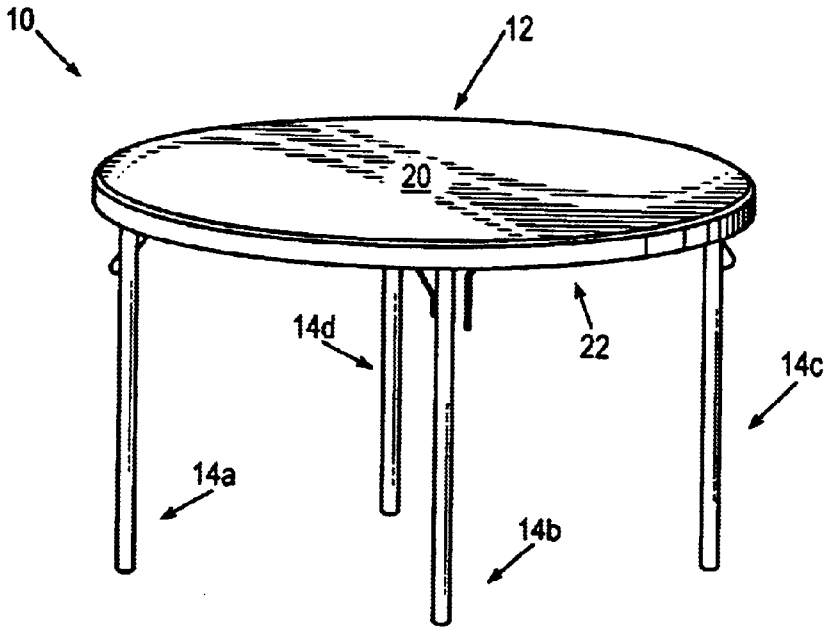
FIG. 1 is a top perspective view of a table in accordance with a preferred embodiment of the invention.
Figure 2:
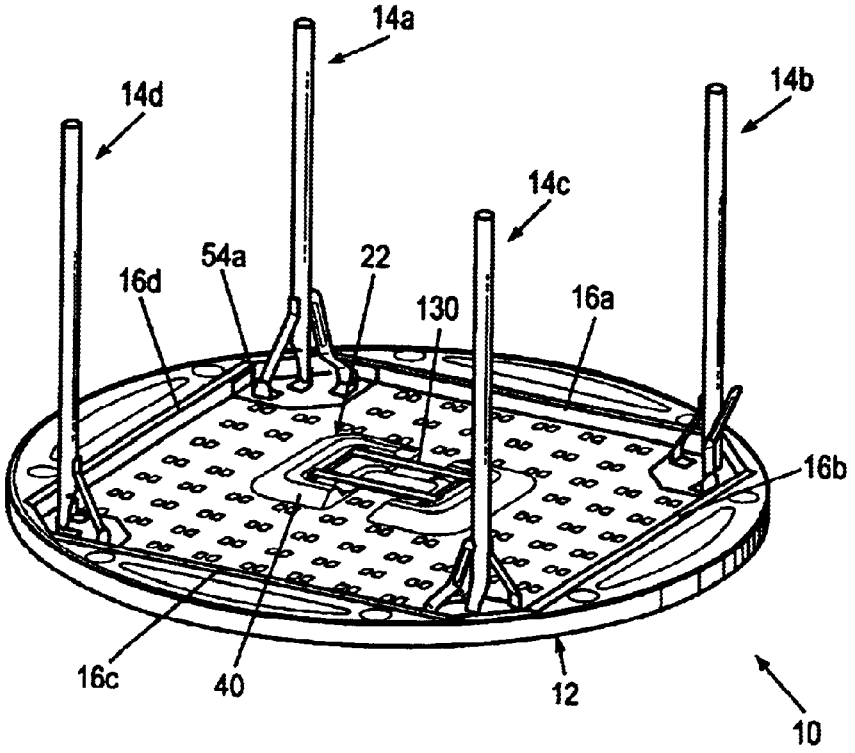
FIG. 2 is an inverted bottom perspective view of the table of FIG. 1.
Figure 3:
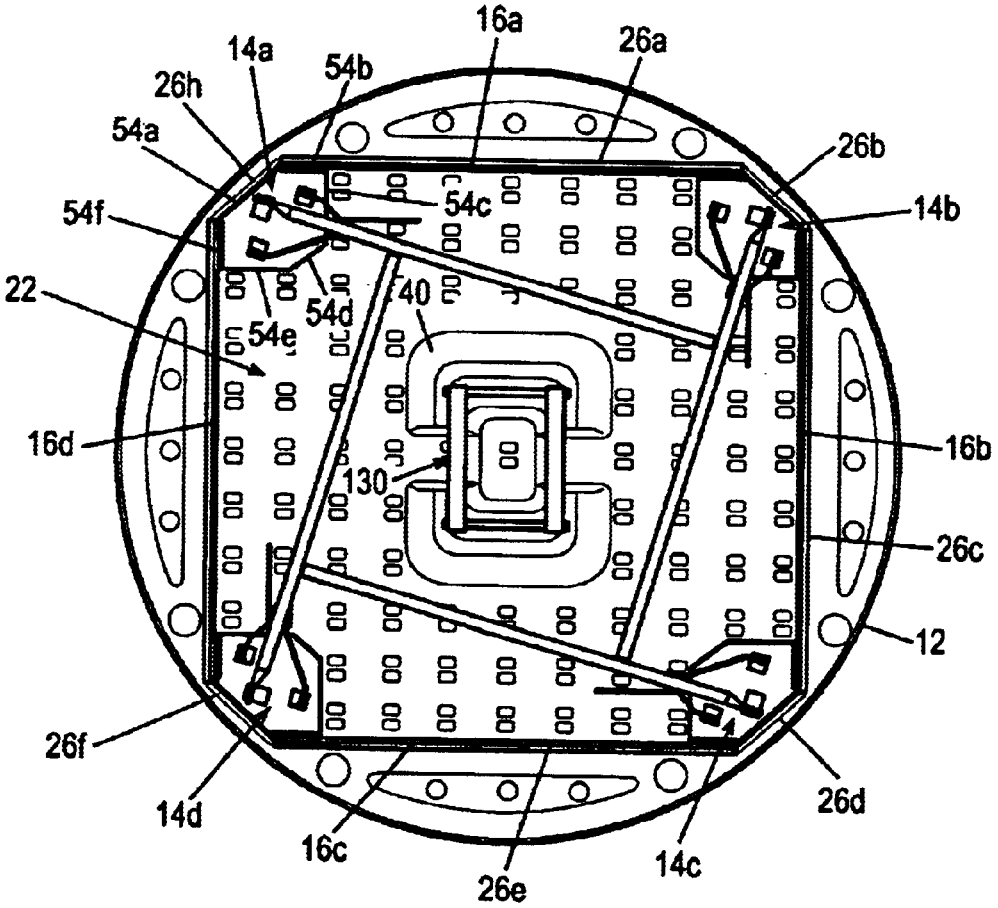
FIG. 3 is a bottom view of the table of FIGS. 1 and 2 with the legs in a folded orientation.

With reference to FIGS. 1 and 2, the invention relates to a table 10 having a table top 12, a plurality of folding leg assemblies 14*a*–14*d*, and a plurality of frame members 16*a*–16*d*. The invention advantageously provides a construction having improved compactness when the legs are folded as well as improved weight and strength characteristics. FIG. 3 shows the leg assemblies in a folded orientation.

Table Top 12

Figure 4A:
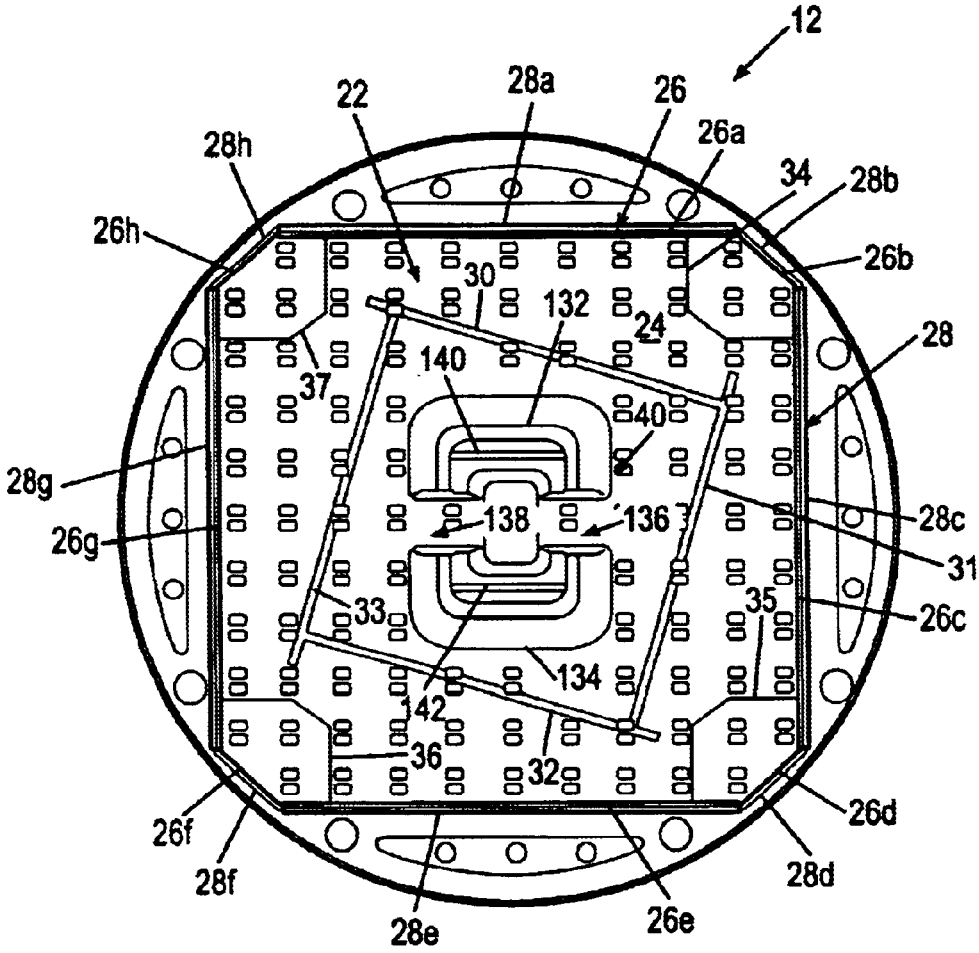
FIG. 4A is a bottom view of a table top component of the table of FIG. 1.
Figure 4B:
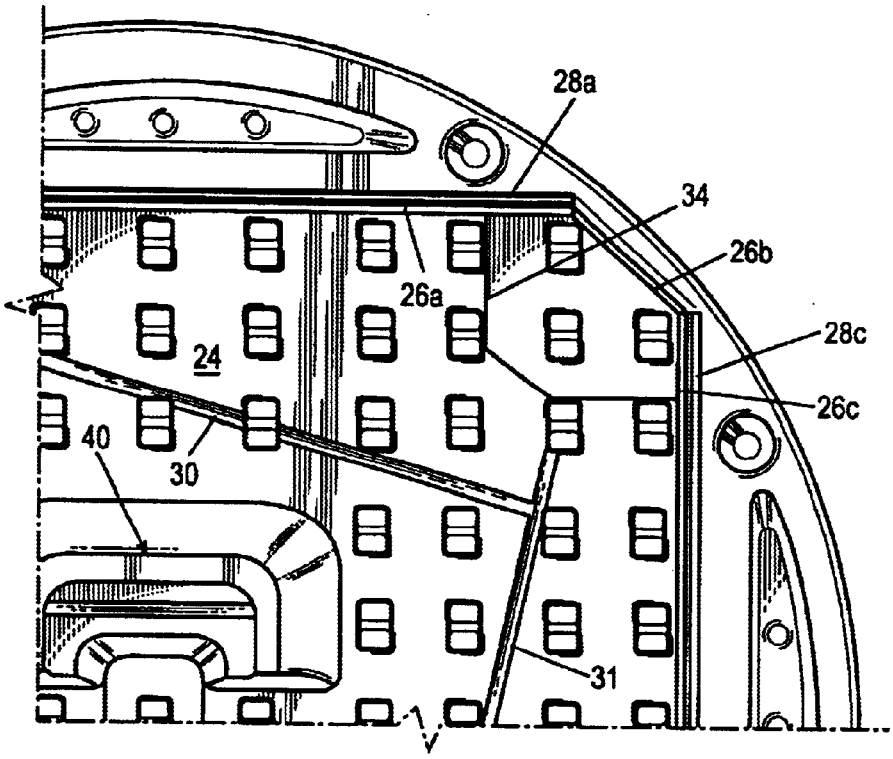
FIG. 4B is a close-up view of a portion of FIG. 4A.

With reference to FIGS. 1, 4A, and 4B, the table top 12 is preferably of one-piece molded plastic construction and includes an upper, preferably planar, surface 20 opposite a lower surface 22. The table top 12 is shown having a rounded configuration, but it will be understood that it may be of other configuration, such as elliptical, square, rectangular, or other shape. Blow-molding is a preferred manufacturing method to yield a table top that is of relatively light weight. However, it will be understood that the table top may be made by other methods and of other materials such as fiberglass, metal, and wood.

The lower surface 22 is preferably configured to facilitate mounting of the leg assemblies 14*a*–14*d* and the frame members 16*a*–16*d*. In this regard, the lower surface 22 preferably includes a recessed central tray region 24. The recessed nature of the tray region 24 provides a surrounding rim 26 having a lip 28 adjacent an upper periphery of the rim 26. The recessed nature of the tray region that provides the rim 26 defines a plurality of sides that extend between the rim 26 and the surface of the tray region 24. In the example of the round table top 12, the tray region 24 preferably has eight tray sides (26*a*, 26*b*, 26*c*, 26*d*, 26*e*, 26*f*, 26*g*, 26*h*), with each tray side having, respectively, lip portions 28*a*–28*h*. The tray, rim and lip structure is preferably formed during molding of the table top 12 and is thus preferably an integral and continuous extension of the lower surface 22. As described below, the tray, rim and lip structure is configured to receive the leg assemblies 14*a*–14*d* and the frame members 16*a*–16*d*.

The tray region 24 also preferably includes grooves or detents 30, 31, 32, and 33 provided on the surface of the tray region 24 configured for receiving portions of the leg assemblies 14*a*–14*d* when the leg assemblies 14*a*–14*d* are in a folded position. In addition, grooves or detents 34, 35, 36, and 37 are preferably located adjacent the sides 26*b*, 26*d*, 26*f*, and 26*h* for facilitating positioning of the leg assemblies 14*a*–14*d*. Additionally, a central portion of the tray region 24 is preferably configured to include a handle mount 40, described in more detail below. The grooves and handle mount structures are also preferably formed during the molding of the table top 12.

Leg Assemblies 14

Figure 5:
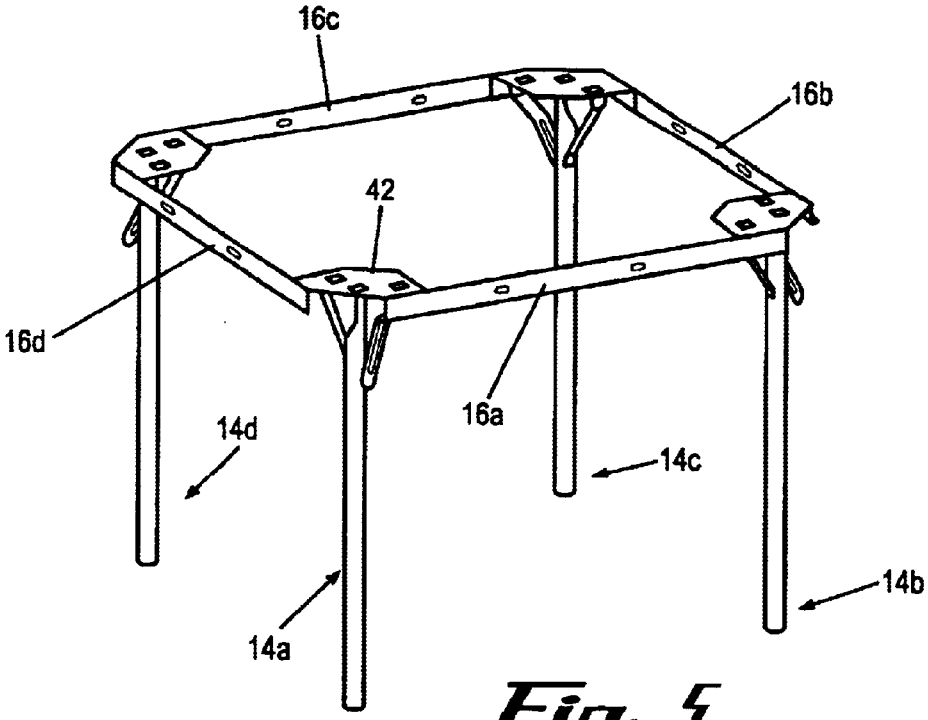
FIG. 5 is a perspective view of frame and leg assembly components of the table of FIG. 1.

With reference to FIG. 5, the leg assemblies 14*a*–14*d* are shown oriented with the frame members 16*a*–16*d* as if mounted on the surface 22 of the table top 12 and in an unfolded orientation. With additional reference to FIG. 6, there is shown the leg assembly 14*a*, which is representative of the other assemblies 14*b*–14*d*. As seen, the assembly 14*a* includes a bracket 42, a leg 44, a leg lock member 46, and a leg brace member 48. Each of the components of the assembly 14*a* is preferably made of metal, such as steel. However, it will be understood that other materials may be used, such as wood, plastic, or composite materials.

Figure 7:
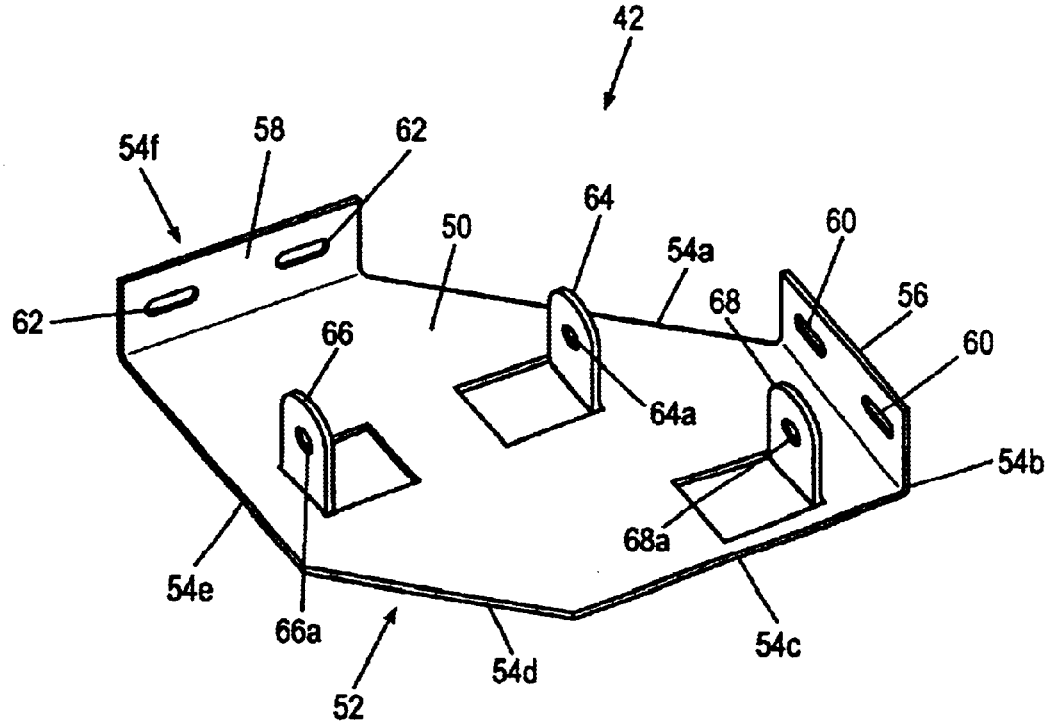
FIG. 7 shows a corner bracket component of the leg assembly of FIG. 6.

With reference to FIG. 7, the bracket 42 preferably includes an upper surface 50, an opposite lower surface 52, and sides 54*a*–54*f*. An extension 56 extends upwardly from the side 54*b* and an extension 58 extends upwardly from the side 54*f* The extensions 56 and 58 are preferably normal to the surface 50. The bracket 42 is preferably formed from a single sheet of metal and the extensions 56 and 58 may be formed as by bending. The extension 56 preferably includes mounting slots 60 extending through the thickness thereof. Likewise, the extension 58 preferably includes mounting slots 62. As will be appreciated, the extensions 56 and 58 facilitate mounting and securement of the bracket 42 to the table top 12.

The bracket 42 also preferably includes mounts 64, 66, and 68 extending upwardly from the surface 50. The mounts 64–68 are configured for mounting, respectively, the leg 44, the lock member 46, and the brace member 48. In this regard, the mounts 64–68 preferably include apertures 64*a*, 66*a*, and 68*a*. The mounts 64–68 are preferably formed as by scoring portions of the surface 50 and bending upwardly the material within the scores so as to provide the mounts 64–68. The mounts 64–68 are preferably configured to extend relatively normal to the surface 50.

Returning to FIG. 6, the leg 44 is preferably an elongate tubular member having a floor contact end 70 and an opposite mounting end 72. The mounting end 72 is preferably provided as by a substantially flat end portion 74 that extends outwardly from the leg 44 in a direction generally parallel to the length axis of the leg 44. An aperture 74*a* extends through the end portion 74. As will be seen, the leg 44 is pivotally mounted to the bracket 42 as by positioning the flat end portion 74 adjacent a corresponding flat surface of the mount 64 so that the apertures 74*a* and 64*a* are aligned, with a fastener, such as a rivet or bolt or the like passed through the aligned apertures 64*a* and 74*a*. Although the leg 44 is preferably a tube having a cylindrical cross-section, it will be appreciated that the leg 44 may have other cross-sectional shapes, such as rectangular or oval.

Figure 6:
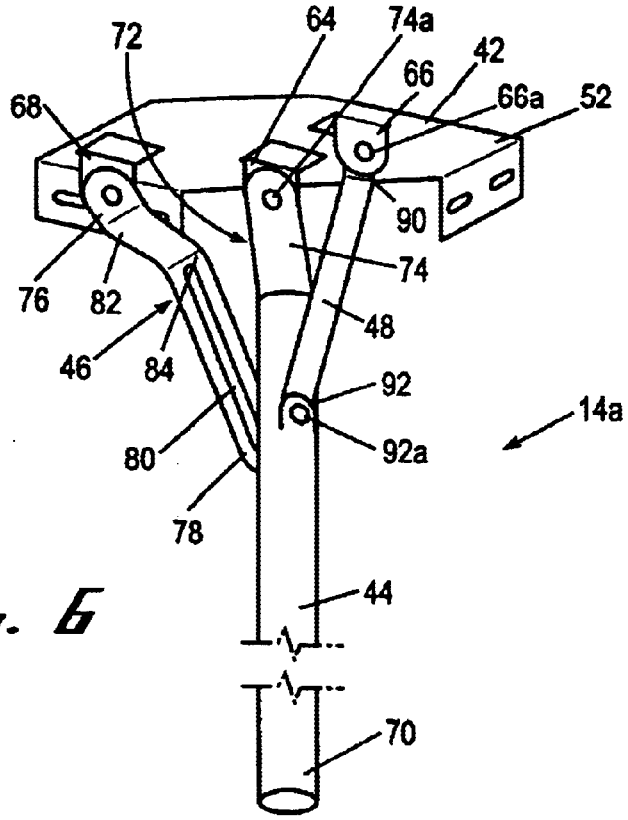
FIG. 6 is a perspective view of a leg assembly.
Figure 8:
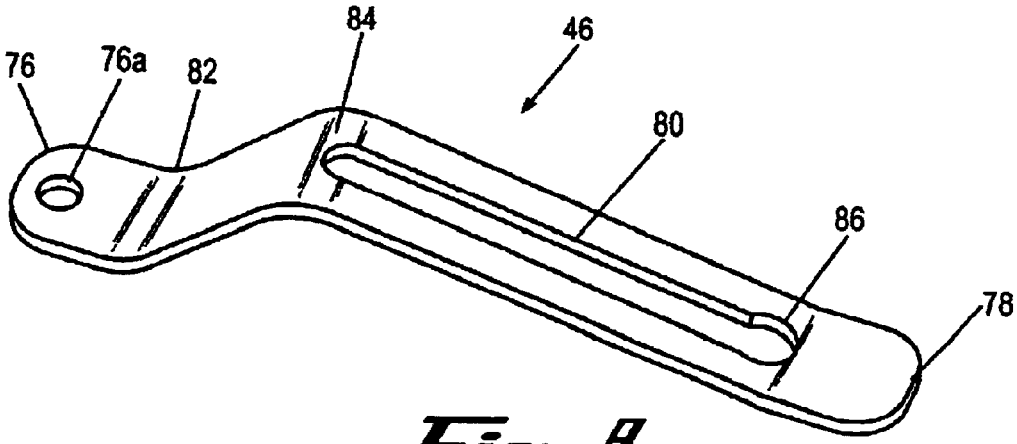
FIG. 8 shows a leg lock component of the leg assembly of FIG. 6.

With reference to FIGS. 6 and 8, the leg lock member 46 is preferably an elongate strip of metal having opposite rounded ends 76 and 78. An aperture 76*a* extends through the end 76 and an elongate slot 80 extends through the member 46 from a location adjacent the end 78. An outward bend 82 is located adjacent the end 76 and an inward bend 84 is located adjacent the end of the slot 80 opposite the end 78. The bends 82 and 84 are preferably configured such that the ends 76 and 78 lie in substantially parallel but spaced apart planes, with the slot 80 located in substantially a single plane. The end of the slot 80 adjacent the end 78 is preferably enlarged to provide an opening 86.

The leg lock member 46 may be pivotally mounted to the bracket 42 as by positioning the end 76 flat adjacent a corresponding flat surface of the mount 68 so that apertures 68*a* and 76*a* are aligned, with a fastener, such as a rivet or bolt or the like passed through the aligned apertures 68*a* and 76*a* to enable the member 46 to be pivotally attached to the mount 68. In addition, the slot 80 is positioned adjacent the leg 44 so that the opening 86 is adjacent a central portion of the leg 44 when the leg 44 is fully unfolded. A fastener, such as a rivet or a screw or the like may be passed through the slot 80 and into a corresponding opening provided in the sidewall of the leg 44. As will be appreciated, a head or other structure of the fastener may be captured by the opening 86 to lock the leg 44 in the unfolded configuration. The member 46 may be pressed or otherwise manipulated to release the fastener from locking engagement with the opening 86, with a shank or body portion of the fastener captured within the slot 80. Thus, the leg 44 may be returned to a folding orientation.

Figure 9:
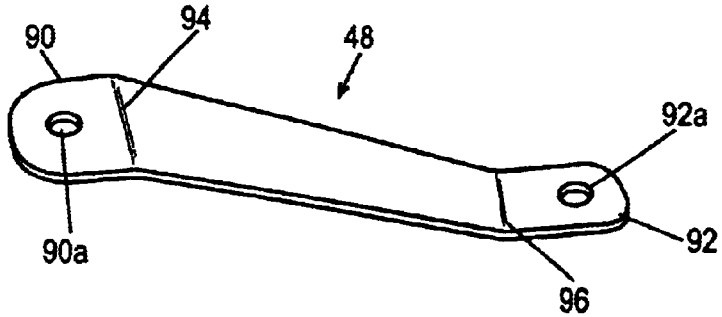
FIG. 9 shows a leg brace component of the leg assembly of FIG. 6.

With reference to FIGS. 6 and 9, the leg brace member 48 is preferably an elongate strip of metal having opposite ends 90 and 92. An aperture 90*a* extends through the end 90 and an aperture 92*a* extends through the end 92. A bend 94 is located adjacent the end 90 and a bend 96 is located adjacent the end 92. The bends 94 and 96 are preferably configured such that the ends 90 and 92 lie in substantially parallel but spaced apart planes. The brace member 48 may be pivotally mounted to the bracket 42 as by positioning the end 90 flat adjacent a corresponding flat surface of the mount 66 so that apertures 66*a* and 90*a* are aligned, with a fastener, such as a rivet or bolt or the like passed through the aligned apertures 66*a* and 90*a* to enable the member 48 to be pivotally attached to the mount 66. In addition, the aperture 92*a* is positioned adjacent the leg 44 so that the aperture 92*a* is adjacent a central portion of the leg 44 when the leg 44 is fully unfolded, preferably directly opposite the side of the leg 44 that the member 46 is connected to. A fastener, such as a rivet or a screw or the like may be passed through the aperture 92*a* and into a corresponding opening provided in the sidewall of the leg 44.

Frame Members 16*a*–16*d*

Figure 10:
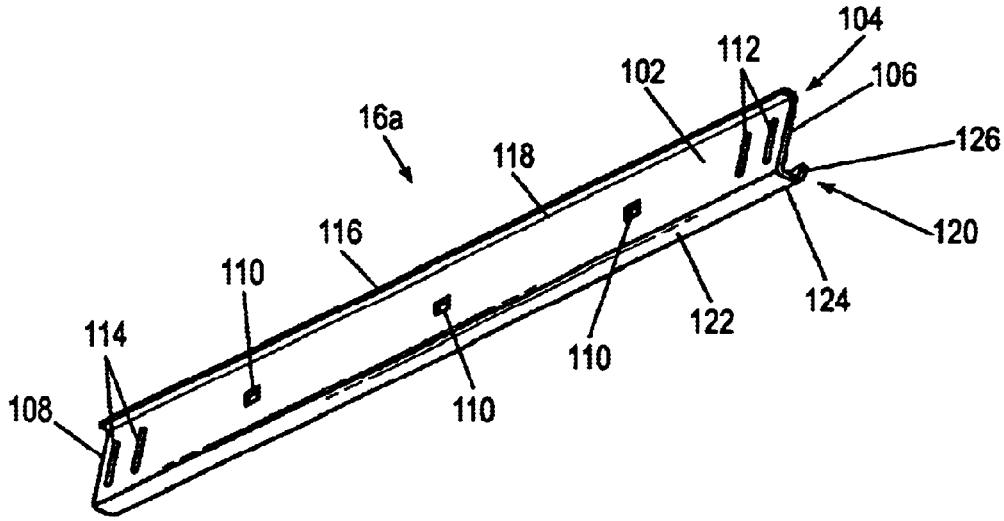
FIG. 10 shows a frame member.

With reference to FIG. 10, there is shown the frame member 16*a*, which is representative of the members 16*b*–16*d*. As seen, the member 16*a* is preferably of one-piece construction and includes a generally elongate and planar body 100 having opposite sides 102 and 104, and opposite ends 106 and 108. A plurality of apertures 110 extend between the surfaces 102 and 104 at various locations along the length of the member 16*a*. Slots 112 and 114 are preferably located adjacent the ends 106 and 108, respectively. The slots 112 and 114 preferably have a length generally normal to the length of the member 16*a*. An elongate lip 116 projects outwardly from an edge 118 of the body 100 in a direction generally normal to and away from the side 102. The lip 116 preferably extends the length of the member 16*a*. A lip 120 projects outwardly from an opposite edge 122 in a direction generally normal to and away from the side 104. The lip 120 preferably includes a bend 124 to provide an extension 126. The bend 124 is preferably formed so that the extension 126 is generally parallel to the side 104 and spaced apart therefrom.

The members 16*a*–*d* are preferably made of metal, such as steel. However, it will be understood that other materials may be used, such as wood, plastic, or composite materials. It will also be appreciated that the members 16*a*–*d* could be elongate tubes, such as cylindrical, half-round, or rectangular cross-section tubes.

Assembly of the Components

Figure 11:
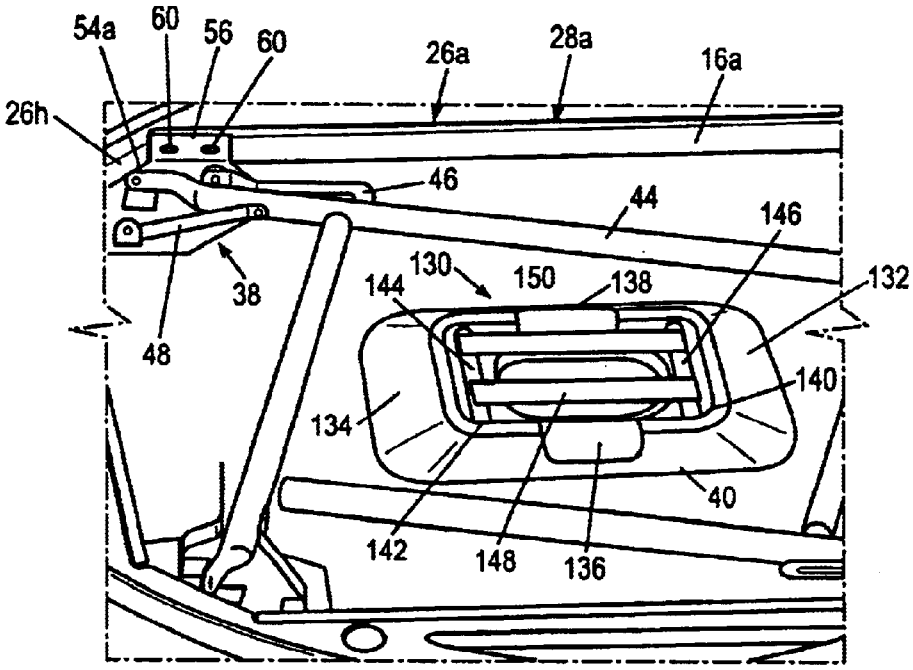
FIG. 11 is a close-up view of the underside of the table of FIG. 1.
Figure 12:
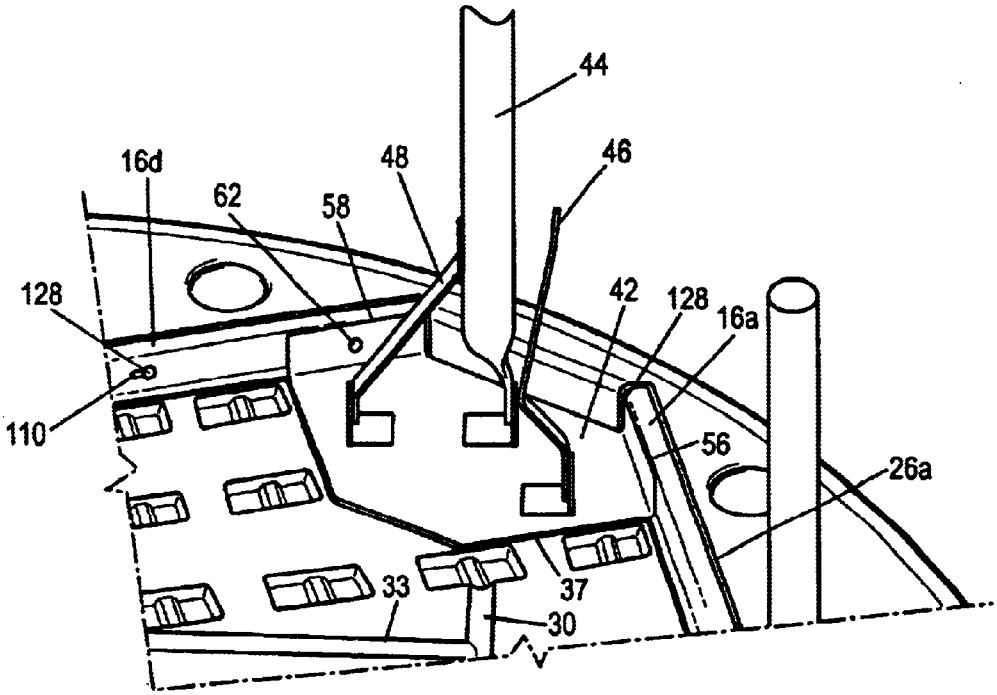
FIG. 12 is a close-up view showing a leg assembly and frame members mounted to the table top.

Returning to FIGS. 2–7 and with reference to FIGS. 11 and 12, the table 10 may be constructed by connecting the leg assemblies 14*a*–14*d* and the frame members 16*a*–16*d* to the table top 12. For example, the frame members 16*a*–16*d* are positioned adjacent the sides 26*a*, 26*c*, 26*e*, and 26*g* of the top 12 and secured thereto as by fasteners, such as screws 128, passed through the apertures 110 of the frame members and screwed into the sides of the table top 12. The leg assemblies 14*a*–14*d* are then placed in their respective detents 34–37 so that the slots 60–62 of the brackets 42 align with corresponding apertures 110 of the frame members 16*a*–16*d*. For example, lower surface 52 of the bracket 42 of the leg assembly 14*a* is preferably positioned within the correspondingly shaped detent 37 of the table top 12 such that the side 54*a* of the bracket 42 is adjacent the side 26*h* of the top 12. Fasteners, such as the screws 128, are then passed through the aligned slots 60 and 62 and the apertures 110 and into the sides of the table top 12.

The table of the invention is lightweight and uncomplicated in configuration and more easily assembled as compared to prior tables. In addition, the construction results in a table that is substantially compact as compared to prior tables. Thus, the table of the invention is relatively convenient to store and transport. In this regard, the handle mount 40 is preferably configured to enable installation of a bidirectional handle assembly 130 that enables a user to conveniently obtain a suitable hand hold from opposed sides of the table. With reference to FIGS. 4*a* and 11, the mount 40 is preferably integrally formed with the top 12 during molding and includes a pair of spaced apart and generally U-shaped ridges 132 and 134 separated by a pair of opposed gaps 136 and 138. The gaps 136 and 138 are sized to be slightly greater than the width of an average human hand.

A preferably semi-cylindrical depression 140 is formed across a closed end of the ridge 132 and a corresponding depression 142 is formed across a closed end of the ridge 134. The depressions 140 and 142 are configured to fittingly receive rods 144 and 146 of the handle assembly. If desired, fasteners such as screws may be used to additionally secure the rods 144 and 146 within the depressions 140 and 142. The handle assembly 130 further includes a pair of slats 148 and 150 that extend between and are attached to the rods 144 and 146. The slats 148 and 150 provide surfaces for grasping by a user. The rods 144 and 146 as well as the slats 148 and 150 may be made of virtually any material, but most preferably of aluminum, with the components attached as by welding.

The foregoing embodiments of this invention have been presented for purposes of illustration and description. They are not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A table assembly, comprising:

a table top having a substantially planar upper surface and an opposing lower surface, the lower surface of the table top including a recessed central tray region having a plurality of tray sides extending between the tray region and surrounding portions of the lower surface;

a plurality of leg assemblies mountable adjacent the lower surface and within the central tray region, each of the leg assemblies including:

a bracket having a first surface positioned adjacent the central tray region, an opposing second surface, and a plurality of mounts extending substantially normal from the second surface of the bracket, the bracket further including at least two extensions adjacent edges of the bracket and extending in a direction away from and substantially normal to the second surface, each of the extensions having at least one aperture extending between opposing first and second surfaces of the extension, the second surface of each extension being positioned adjacent a portion of one of the tray sides, and a leg pivotally mounted to the mounts;

a plurality of frame members, each of the frame members having a first side and an opposing second side, with the first side of each of the frame members being positioned adjacent a portion of one of the tray sides and a portion of the second side of each of the frame members being positioned adjacent the second surface of one of the extensions of one of the brackets so that a portion of each of the frame members is positioned between the second surface of one of the extensions of the bracket and one of the tray sides, each of the frame members further including at least one aperture extending between the first and second sides of the frame member and located in substantial alignment with the aperture of one of the extensions of one of the brackets, and a fastener extending through the aligned apertures of adjacent extensions and frame members and into a portion of the tray side to mount the frame members and the leg assemblies to the table top.

2. The table assembly of claim 1, wherein the tray region includes detents configured for receiving portions of the leg assemblies.

3. The table assembly of claim 1, wherein each of the leg assemblies further includes a leg lock member and a leg brace member, each of which is pivotally mounted to one of the mounts of the bracket.

4. The table assembly of claim 1, wherein each of the frame members is elongate and includes a generally planar body having opposite sides.

5. The table assembly of claim 1, wherein the table top is generally round and the plurality of tray sides comprises eight tray sides.

6. The table assembly of claim 1, wherein the bracket includes at least four edges, with three of the edges thereof positioned adjacent one of the tray sides.

7. The table assembly of claim 1, wherein the table top is of one-piece molded plastic construction.

8. The table assembly of claim 1, wherein the tray region further includes a handle mount having a pair of spaced apart and generally U-shaped ridges separated by a pair of opposed gaps sized to be slightly greater than the width of an average human hand, with a depression formed across a closed end of each of the ridges.

9. The table assembly of claim 8, further comprising a handle assembly fittingly received by the handle mount, the handle assembly comprising a rod received within each depression and a slat extending between and attached to the rods.

10. A table assembly, comprising:

a table top having a lower surface with a recessed central tray region and tray sides extending between the tray region and surrounding portions of the lower surface;

leg assemblies mountable adjacent the lower surface and within the central tray region, each of the leg assemblies including:

a bracket having a plurality of mounts and at least two extensions adjacent edges of the bracket and positioned adjacent a portion of one of the tray sides, and a leg pivotally mounted to the mounts;

a plurality of frame members positioned so that a portion of each of the frame members is positioned between one of the tray sides and one of the extensions of the one of the brackets; and a fastener extending through each of the extensions and a portion of the adjacent frame member and into a portion of the tray side for mounting of the frame members and the leg assemblies to the table top.

* * * * *